US006260522B1

(12) United States Patent
Stolk et al.

(10) Patent No.: US 6,260,522 B1
(45) Date of Patent: Jul. 17, 2001

(54) DEVICE FOR ACTUATING A GAS EXCHANGE VALVE HAVING AN ELECTROMAGNETIC ACTUATOR

(75) Inventors: Thomas Stolk, Kirchheim; Alexander von Gaisberg, Beilstein, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/569,530

(22) Filed: May 12, 2000

Related U.S. Application Data

(63) Continuation-in-part of application No. PCT/EP98/06761, filed on Oct. 24, 1998.

(30) Foreign Application Priority Data

Nov. 13, 1997 (DE) ..... 197 50 228

(51) Int. Cl.[7] ..... F01L 9/04

(52) U.S. Cl. ..... 123/90.11; 123/90.65; 251/129.16

(58) Field of Search ..... 123/90.11, 90.65, 123/90.67, 188.17, 188.13; 251/129.01, 129.15, 129.16

(56) References Cited

U.S. PATENT DOCUMENTS 5,785,016 * 7/1998 Enderle et al. ..... 123/90.11
5,832,883 * 11/1998 Bae ..... 123/90.11
5,927,237 * 7/1999 Komatsu et al. ..... 123/90.11

FOREIGN PATENT DOCUMENTS 195 11 880 10/1995 (DE) .
196 47 305 2/1998 (DE) .
2 137 420 10/1984 (GB) .

* cited by examiner

*Primary Examiner*—Weilun Lo
(74) *Attorney, Agent, or Firm*—Klaus J. Bach

(57) ABSTRACT

In a device for actuating a gas exchange valve of an internal combustion engine, which actuating device includes an electromagnetic actuator and is floatingly supported on the cylinder head so as to provide for a play compensation structure, axially spaced valve opening and closing magnets having opposite pole faces are arranged in spaced relationship and an armature is axially movably disposed between the opposite pole faces and connected to the valve shaft of the gas exchange valve, and valve closing and opening springs are disposed at opposite sides of a spring support plate mounted for movement with the valve shaft, wherein the valve closing spring is supported on the actuating device and means are provided for biasing the actuating device into a valve closing direction.

10 Claims, 2 Drawing Sheets

DEVICE FOR ACTUATING A GAS EXCHANGE VALVE HAVING AN ELECTROMAGNETIC ACTUATOR

This is a CIP application of international application PCT/EP98/06761 filed Oct. 24, 1998 and claiming the priority of German application 197 50 228.8 filed Nov. 13, 1997.

BACKGROUND OF THE INVENTION

The invention relates to a device for actuating a gas exchange valve having an electromagnetic actuator, which is floatingly supported in a cylinder head and abuts a play compensation element.

Electromagnetic actuators for actuating gas exchange valves usually have two operating magnets, specifically an opening magnet and a closing magnet, between the pole faces of which an armature is arranged such that it can be displaced co-axially in relation to a valve axis. The armature acts directly, or via an armature tappet, on a valve stem of the gas exchange valve. In the case of actuators operating in accordance with the mass-oscillator principle, a pre-stressed spring mechanism acts on the armature. Usually two pre-stressed compression springs, to be precise a top and a bottom valve spring, are used as the spring mechanism. The top valve spring acts in the opening direction, and the bottom valve spring acts in the closing direction of the gas exchange valve. When the magnets are not excited, the armature is retained by the valve springs in a position of equilibrium between the magnets.

When the actuator is initially activated, either the closing or the opening magnet is briefly over-excited, or the magnets are excited at the resonant frequency of the armature by an oscillation excitation routine, in order to be moved out of the equilibrium position. In the closed position of the gas exchange valve, the armature bears against the pole face of the energized closing magnet and is retained by the same. The closing magnet compresses further the valve spring, which acts in the opening direction. In order to open the gas exchange valve, the closing magnet is de-energized and the opening magnet is energized. The valve spring which acts in the opening direction accelerates the armature beyond the position of equilibrium, with the result that said armature is attracted by the opening magnet. The armature strikes the pole face of the opening magnet and is securely held by the same. In order to close the gas exchange valve again, the opening magnet is de-energized and the closing magnet is energized. The valve spring, which acts in the closing direction, accelerates the armature beyond the position of equilibrium toward the closing magnet. The armature is attracted by the closing magnet, strikes against the pole face of the closing magnet and is held by the same.

Variables, which have not been taken into account from the very beginning or which vary over time, such as production tolerances of individual components, rates of thermal expansion of different materials, differing levels of spring rigidity between the top and bottom valve springs, and settling of the springs as a result of the valve springs aging, etc., may result in a situation where the position of equilibrium determined by the valve springs does not correspond to an energetic center position between the pole faces or does not have a specific position. Furthermore, such variables may bring about situations where the armature no longer comes to bear fully on the pole faces of the magnets, where there is play between the armature stem and the valve stem and/or the gas exchange valve no longer closes completely.

An earlier application, DE 19 647 305.5, illustrates a play-compensation element in which an actuator is floatingly mounted in a cylinder head. The actuator opens and closes a gas exchange valve via an armature and two electromagnets, which are arranged on either side in the direction of movement of the armature. The spring mechanism is arranged between the actuator and the valve disc of the gas exchange valve. The top- that is the opening spring is supported on the actuator and the bottom- that is the closing spring is supported on the cylinder head. On the side remote from the gas exchange valve, a play-compensation element, which compensates both positive and negative valve play, is located between a cover plate and the actuator.

The play-compensation element has a first hydraulic element with a play-compensation piston in a cylinder. The play-compensation piston is located between a first pressure space, which is remote from the gas exchange valve and is controlled as a function of the internal combustion engine operating conditions, and a second pressure space, which is disposed adjacent the gas exchange valve. Located in the piston is a non-return valve, which is retained in the closed position by a closing spring. The non-return valve opens in the direction of the second pressure space when there is excess pressure in the first pressure space. The closing spring is configured such that the non-return valve does not open if there is no play, and thus interrupts the connection between the two pressure spaces.

Between the play-compensation piston and the cylinder there is a defined amount of play providing for a throttled path through which pressure medium can escape from the second pressure space. The play-compensation element is supported on the top cover plate, which is fixedly connected to the cylinder head. The play-compensation element may transmit either just compression forces or, in another embodiment, during the closing operation, compressive and tensile forces.

If the gas exchange valve does not close completely because the actuator is displaced too far in the direction of the gas exchange valve, i.e. there is negative play, the pressure in the second pressure space increases because a gas-exchange-valve valve spring acts in the closing direction. The pressure increase means that the pressure medium can escape from the second pressure space via the throttle path until the gas exchange valve closes again completely.

If the gas exchange valve closes correctly, but there is play between the armature tappet and the gas exchange valve, the valve spring of the gas exchange valve no longer acts on the second pressure space. The pressure in the second pressure space thus drops below that of the first pressure space, with the result that the non-return valve opens against the closing spring. The pressure medium flows from the first pressure space into the second pressure space until the play has been compensated for. This operation may last a number of working cycles of the valve. Since the position of the actuator changes during play compensation, the position of equilibrium of the valve springs thus also changes, with the result that it no longer corresponds to the energetic center position. This, however, changes the oscillating behavior of the spring mechanism, the energy requirement for the magnets and the opening and closing operations of the gas exchange valve.

It is the object of the invention is to provide a mechanism for actuating gas exchange valves having a play-compensation element, in which the position of equilibrium of the spring mechanism is independent of a displacement of the actuator.

SUMMARY OF THE INVENTION

In a device for actuating a gas exchange valve of an internal combustion engine, which actuating device includes an electromagnetic actuator and is floatingly supported on the cylinder head so as to provide for a play compensation structure, axially spaced valve opening and closing magnets having opposite pole faces are arranged in spaced relationship and an armature is axially movably disposed between the opposite pole faces and connected to the valve shaft of the gas exchange valve and valve closing and opening springs are disposed at opposite sides of a spring support plate mounted on the valve shaft, the valve closing spring being supported on the actuating device and means are provided for biasing the actuating device into a valve closing direction.

The spring mechanism is thus supported on the actuator itself to form therewith a structural unit, in which the position of equilibrium of the valve springs is independent of the position of the structural unit relative to the cylinder head. The actuator may be assembled, adjusted and checked outside the cylinder head.

The spring chamber may easily be formed by a sheet metal housing, which encloses the actuator and is supported on the end of the actuator which is remote from the spring chamber. In this case, the supporting surfaces of the sheet-metal housing are advantageously formed by bent-over edge portions.

In another embodiment the spring chamber is formed by a cup, which is screwed to the actuator. In this case, the screw thread is preferably arranged on a protrusion of the actuator, at the end of the latter, which is directed towards the gas exchange valve. The position of equilibrium of the spring mechanism may be adjusted via the screw-connection, which is secured against release, for example by a counter nut.

The valve spring, which acts in the closing direction, is supported on the corresponding end side of the spring chamber by way of its free end. This end wall may easily be formed by a supporting disc which is supported on an inner shoulder of the spring chamber, e.g. on a flank formed by an annular groove. For straightforward assembly and for the purpose of reducing the number of parts, it is expedient for the valve springs to have a common spring plate which is braced between a neck on the valve stem and a spacer sleeve by means of a screw-connection. Once the actuator has been inserted into the cylinder head, the gas exchange valve may thus be introduced into the actuator from the combustion-chamber side and connected to the spring plate, the armature already being fixed in the pre-assembled actuator on the spacer sleeve.

According to one configuration of the invention, the play-compensation element is formed by a spring, which is supported on the cylinder head and loads the actuator in the direction of the closing position with a relatively small closing force. This ensures that the gas exchange valve is closed in a play-free manner. Possible changes because of wear or settling are compensated. Furthermore, there is no need for any additional pre-stressing of the valve springs. Furthermore, there is no need for hydraulic valve compensation. The moving masses are reduced as a result. Moreover, no oil supply is necessary.

Further advantages will become apparent from the following description of the drawings, wherein exemplary embodiments of the invention are illustrated in the drawing. The description and the claims contain numerous features in combined form. The person skilled in the art will be able to consider the features individually and combine them to form further combinations.

DESCRIPTION OF PREFERRED EMBODIMENTS

Figure 1:
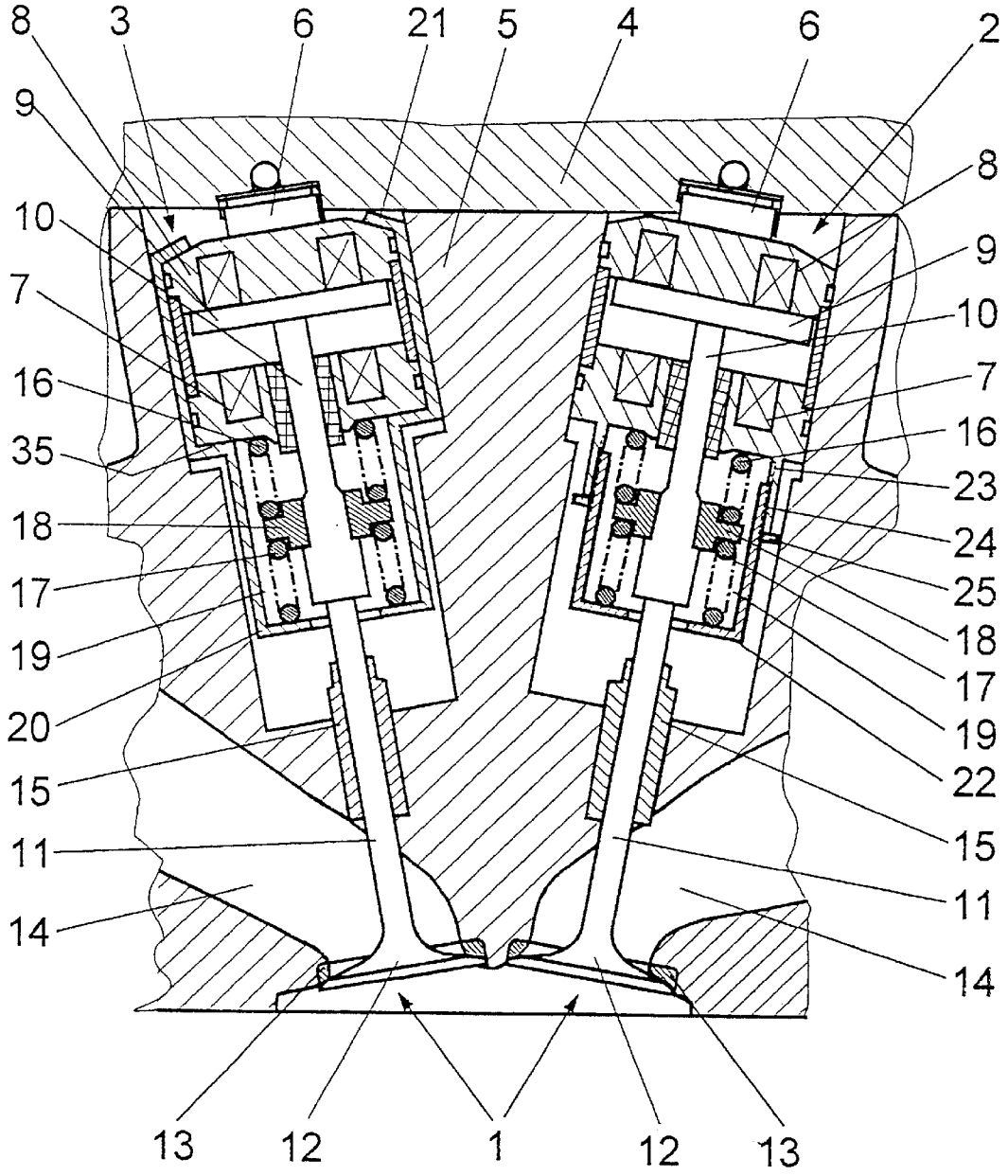
FIG. 1 is a partial sectional view of a cylinder head with two gas exchange valves and two embodiments of an actuator.

FIG. 1 shows two gas exchange valves 1, which control two gas exchange channels 14 in a cylinder head 5 of an internal combustion engine. At the combustion-chamber ends, the gas exchange channels 14 are provided with valve-seat rings 13 against which the gas exchange valves 1 bear by way of the valve discs 12 when the valves are closed.

Electromagnetic actuators 2 and 3 are provided for actuating the gas exchange valves 1. The valves have stems 11, which are guided in the cylinder head 5 by means of valve guides 15. The actuators 2 and 3 have two operating magnets, to be precise a top, closing magnet 8 and a bottom, opening magnet 7. Moving between the pole faces of the magnets 7 and 8 is an armature 9, which acts on the valve stem 11 of the gas exchange valve 1 via an armature tappet 10. The armature tappets 10 are advantageous for manufacturing and assembly reasons. They may be dispensed with if the armatures 9 are connected directly to the valve stems 11.

Between the opening magnets 7 and the gas exchange valves 1, the actuators 2, 3 have spring chambers 19 in which a spring mechanism, comprising two valve springs 16 and 17, is accommodated. The valve springs 16, 17 are supported with one end disposed on a common spring plate 18, which is fastened to the armature tappet 10. In this case, the top, pre-tensioned valve spring 16 acts in the opening direction, being supported on the opening magnet 7 by way of its free end. The bottom, pre-tensioned valve spring 17 acts in the closing direction, being supported on an end wall of the spring chamber 19 adjacent the gas exchange valve 1. The armatures 9 are in an equilibrium position between the valve springs 16, 17 when the magnets are deenergized. This position preferably corresponds to an energetic center position.

The actuators 2, 3 are provided with play-compensation elements 6, which are supported on a cover 4 of the cylinder head 5. They axially readjust the actuators 2, 3, which are mounted in a floating manner in the cylinder head 5, as soon as there is negative or positive play in the closed state of the gas exchange valve 1. Since the valve springs 16 and 17 are located in a spring chamber 19 of the actuators 2, 3, and thus form a structural unit, the equilibrium and the center position are not affected by the adjustment of the actuators 2, 3 by way of the hydraulically acting play-compensation elements 6.

The actuator 2 differs slightly from the actuator 3 by the design of the spring chamber 19. As shown for the actuator 3, the spring chamber is formed by a sheet-metal housing 20 which encloses the actuator 3 in the region of the magnets 7, 8. At its end remote from the spring chamber 19, the housing 20 has bent over portions 21, which form an inwardly extending flange, by way of which the sheet-metal housing 20 is connected to the closing magnet 8. A shoulder 35 of the sheet-metal housing 20, which engages the opening magnet 7, forms an opposite mounting surface.

In the case of the actuator 2, the spring chamber 19 is formed by a cup 22, which is fastened to a protrusion 23 of the opening magnet 7 via a screw thread 24. The screw thread 24, which may be secured by a lock nut 25, serves, at the same time, for adjusting the energetic center position.

Figure 2:
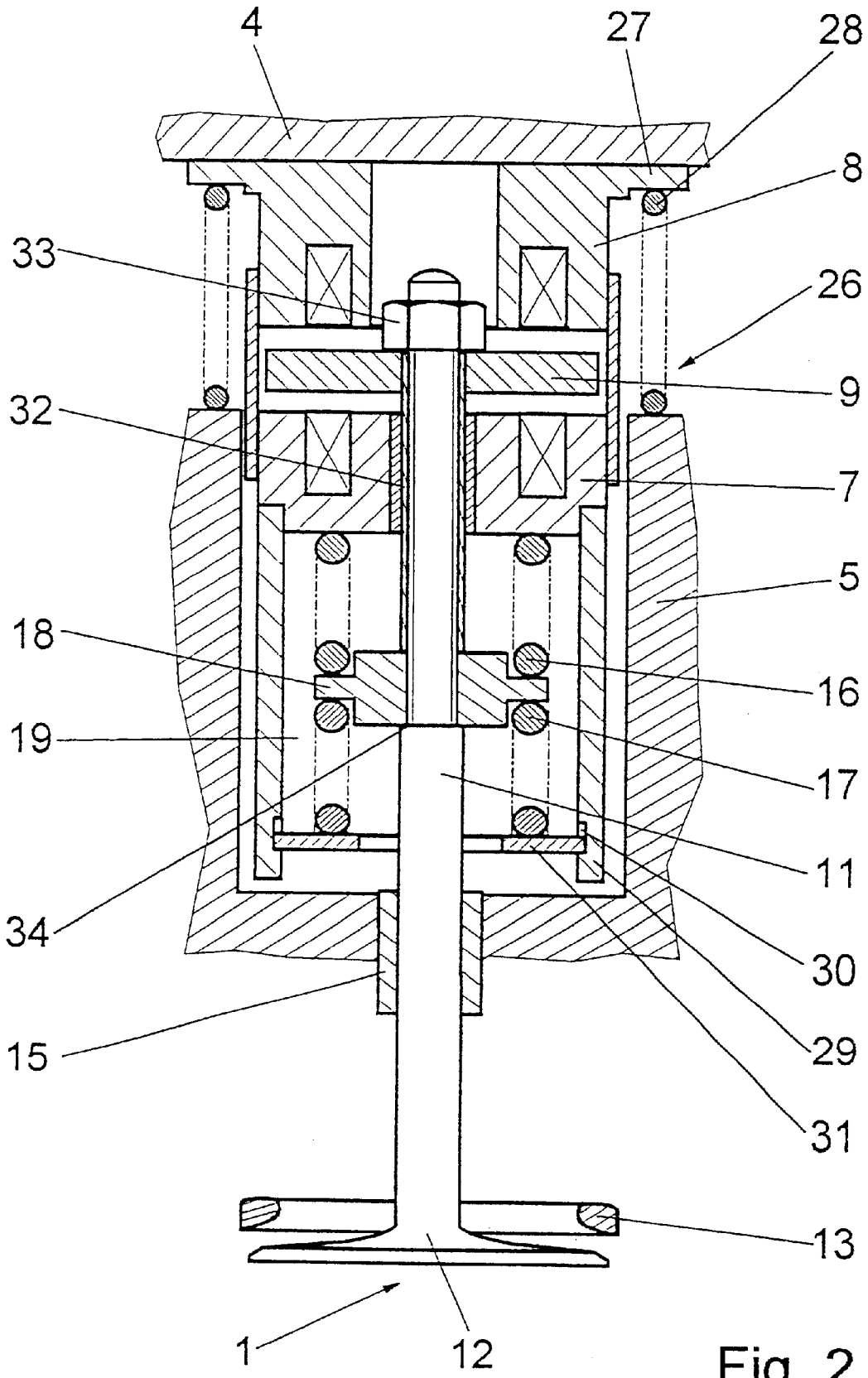
FIG. 2 is a sectional view of a third embodiment of an actuator using a spring as play-compensation element.

The actuator 26 as shown in FIG. 2 has a spring chamber 19 with an end wall on which the spring 17 is supported. The end wall is formed by a supporting disc 31, which is supported on an inner shoulder of the spring chamber wall 29. This shoulder is formed by an outer flank of an annular groove 30 in which the supporting disc 31 is inserted. For this purpose, the supporting disc 31 is of divided or radially resilient design.

In the case of the design according to FIG. 2, the play-compensation element is formed by a spring 28. The spring 28 is supported, at one end, on the cylinder head 5 and, at the other end, on the actuator 26, preferably on a collar 27. It biases the actuator 26 in the closing direction of the gas exchange valve 1 with a relatively small closing force. This ensures that the gas exchange valve 1 always closes in a play-free manner without hydraulic elements and supply lines being necessary for this purpose. Furthermore, the arrangement is lightweight so that the movable masses of the gas exchange valve 1 are relatively low. When the gas exchange valve 1 is opened, the actuator 26 is fully supported on the cover 4.

In the case of the design according to FIG. 2, the spring plate 18 is fastened directly on the valve stem 11 of the gas exchange valve 1. In this case, the spring plate 18, which forms a support common to both valve springs 16 and 17 bears at one side against a neck 34 of the valve stem 11 and, at the other side, is braced via a spacer sleeve 32 by means of a screw-connection 33. With this arrangement, the gas exchange valve 1 can be inserted into the spring plate 18, through the valve guide 15, from the combustion-chamber side of the cylinder head 5 and fastened via the spacer sleeve 32 by means of the screw-connection 33, which is accessible from the outside.

What is claimed is:

1. A device for actuating a gas exchange valve of an internal combustion engine having a cylinder head with gas exchange channels controlled by said gas exchange valves, said actuating device including an electromagnetic actuator floatingly supported in said cylinder head by a play-compensation structure and comprising a gas exchange control valve with a valve shaft arranged in a gas exchange channel so as to normally close the gas exchange channel, axially spaced valve opening and valve closing magnets having opposite pole faces, an armature disposed between said opposite pole faces so as to be axially movable therebetween and being operatively connected to said valve shaft for opening and closing said gas exchange control valve, a valve spring support plate supported for movement with said gas exchange control valve, a valve closing spring supported on said actuator at one side of said spring support plate for biasing said gas exchange control valve in a valve closing direction, a valve opening spring supported on said actuating device at the opposite side of said spring support plate and biasing said gas exchange valves in a valve opening direction against the force of said valve closing spring and means for biasing said actuating device in a valve closing direction.

2. A device according to claim 1, wherein a spring chamber is disposed between said valve opening magnet and said gas exchange control valve, said valve shaft or a valve shaft extension extending through said spring chamber and said spring support plate being mounted on said valve shaft or valve shaft extension within said spring chamber between said valve opening and closing springs.

3. A device according to claim 2, wherein said spring chamber is formed by a sheet metal housing, which encloses said actuator and which is supported at a front end thereof remote from the spring chamber.

4. A device according to claim 3, wherein said metal sheet housing has at its front end bent-over portions, which form a support area.

5. A device according to claim 1, wherein said spring chamber is formed by a pot-like sheet metal housing which is threaded onto said actuator.

6. A device according to claim 5, wherein said actuator has at its front end directed toward said gas exchange control valve a projection which is threaded for engaging said sheet metal housing.

7. A device according to claim 2, wherein said spring chamber includes at its end adjacent said gas exchange control valve, a spring support disc which is supported on a ledge formed internally on said spring chamber.

8. A device according to claim 7, wherein said ledge is formed by an inner annular groove formed in said spring chamber.

9. A device according to claim 1, wherein said valve spring support plate is braced between a shoulder formed on said valve shaft and a spacer sleeve extending between said valve spring support plate and said armature by a screw connection.

10. A device according to claim 1, wherein a spring is arranged between said actuator and said cylinder head for biasing said actuator in a valve closing direction.

* * * * *